US005957317A

United States Patent [19]

Lee

[11] Patent Number: 5,957,317

[45] Date of Patent: Sep. 28, 1999

[54] EVACUATION ACTUATING CLOSURE FOR A CONTAINER

[76] Inventor: Shun-Chich Lee, No. 372 Hsin-Hsing Rd., Hsi-Lo Chen, Yun-Lin Hsien, Taiwan

[21] Appl. No.: 09/109,338

[22] Filed: Jun. 30, 1998

[51] Int. Cl.[6] ..... B65D 31/04

[52] U.S. Cl. ..... 220/212; 220/240; 215/228; 215/262; 215/270

[58] Field of Search ..... 220/212, 231, 220/240, 203.11, 203.23, 203.27, 203.28, 203.29, 367.1, 374; 215/228, 260, 262, 270, 311, 315

[56] References Cited

U.S. PATENT DOCUMENTS

| | | | |
|---|---|---|---|
| 5,406,992 | 4/1995 | Miramon | 215/228 X |
| 5,546,997 | 8/1996 | Miramon | 215/228 X |
| 5,558,243 | 9/1996 | Chu | 220/212 |
| 5,651,470 | 7/1997 | Wu | 220/212 |
| 5,692,632 | 12/1997 | Hsieh et al. | 220/212 |
| 5,779,082 | 7/1998 | Miramon | 220/212 |

*Primary Examiner*—Stephen K. Cronin
*Attorney, Agent, or Firm*—Townsend and Townsend and Crew LLP

[57] ABSTRACT

An evacuation actuating closure includes a lower cap member with a valve seat plate defining a plurality of angularly displaced venting holes at a central area. An annular guiding wall has upper and lower annular portions above and below the valve seat plate. The lower annular portion can be sealingly engaged with an annular upper wall of a container body. An elastomeric disc member includes an elastomeric central portion fixed on the valve seat plate, and a peripheral brim portion to block resiliently the venting holes. The venting holes are unblocked when the pressure below the venting holes is higher than that above the venting holes. An upper cap member includes a transverse depressing portion and an annular skirt portion sleeved on and slidably retained on the annular guiding wall so as to confine an air transit chamber above the valve seat plate. An elastomeric ring-shaped check valve member is disposed between the annular skirt portion and the annular guiding wall. When the transverse depressing portion is depressed, the check valve member is opened to pump out the air in the transit chamber while prohibiting air from entering into the container body.

6 Claims, 7 Drawing Sheets

EVACUATION ACTUATING CLOSURE FOR A CONTAINER

BACKGROUND OF THE INVENTION

1. Field of the Invention

This invention relates to an evacuation actuating closure for a container, more particularly to an evacuation actuating closure which is operated on the container body of the container so as to pump out air from the container body.

2. Description of the Related Art

FIG. 1 illustrates a conventional vacuum container that includes a container body 11, a cap 14 mounted on an annular upper wall 13 of the container body 11, and a venting hole 16 and a check valve 17 which are provided on the cap 14. An air pump 19 is provided on the cap 14 and can be pulled and pushed reciprocatingly for pumping out the air from the container body 11 in order to preserve food stored in the container 10 for a longer period of time. However, the pumping capacity of the air pump 19 is limited only through the venting hole 16, thereby resulting in inconvenient operation.

SUMMARY OF THE INVENTION

The object of the present invention is to provide an evacuation actuating closure for a container which is easily operated on the container body of the container so as to pump out air from the container body.

According to this invention, an evacuation actuating closure includes a lower cap member with a valve seat plate which defines a central area with a plurality of angularly displaced venting holes. An intermediate annular seat wall is disposed upwardly and transversely to the valve seat plate. An annular guiding wall is formed with the valve seat plate and extends in a longitudinal direction so as to form upper and lower annular portions disposed above and below the valve seat plate, respectively. The lower annular portion can be sealingly engaged with an annular upper wall of a container body. An elastomeric disc member includes an elastomeric central portion which is fixedly secured on the central area, and a peripheral brim portion which is disposed to abut resiliently against the intermediate annular seat wall to block the venting holes. The brim portion of the elastomeric disc member yields from abutment against the intermediate annular seat wall when the pressure below the venting holes is higher than that above the venting holes. An upper cap member includes a transverse depressing portion and an annular skirt portion which extends downwardly from the transverse depressing portion and which has an inner annular wall sleeved on and slidably retained on the annular guiding wall so as to confine an air transit chamber between the transverse depressing portion and the valve seat plate. A ring-shaped check valve member is made of an elastomeric material, and is disposed between the inner annular wall and the annular guiding wall. When the transverse depressing portion is depressed downwardly toward the valve seat plate, the check valve member is opened to pump out the air while the transit chamber in prohibiting air from entering into the container body.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
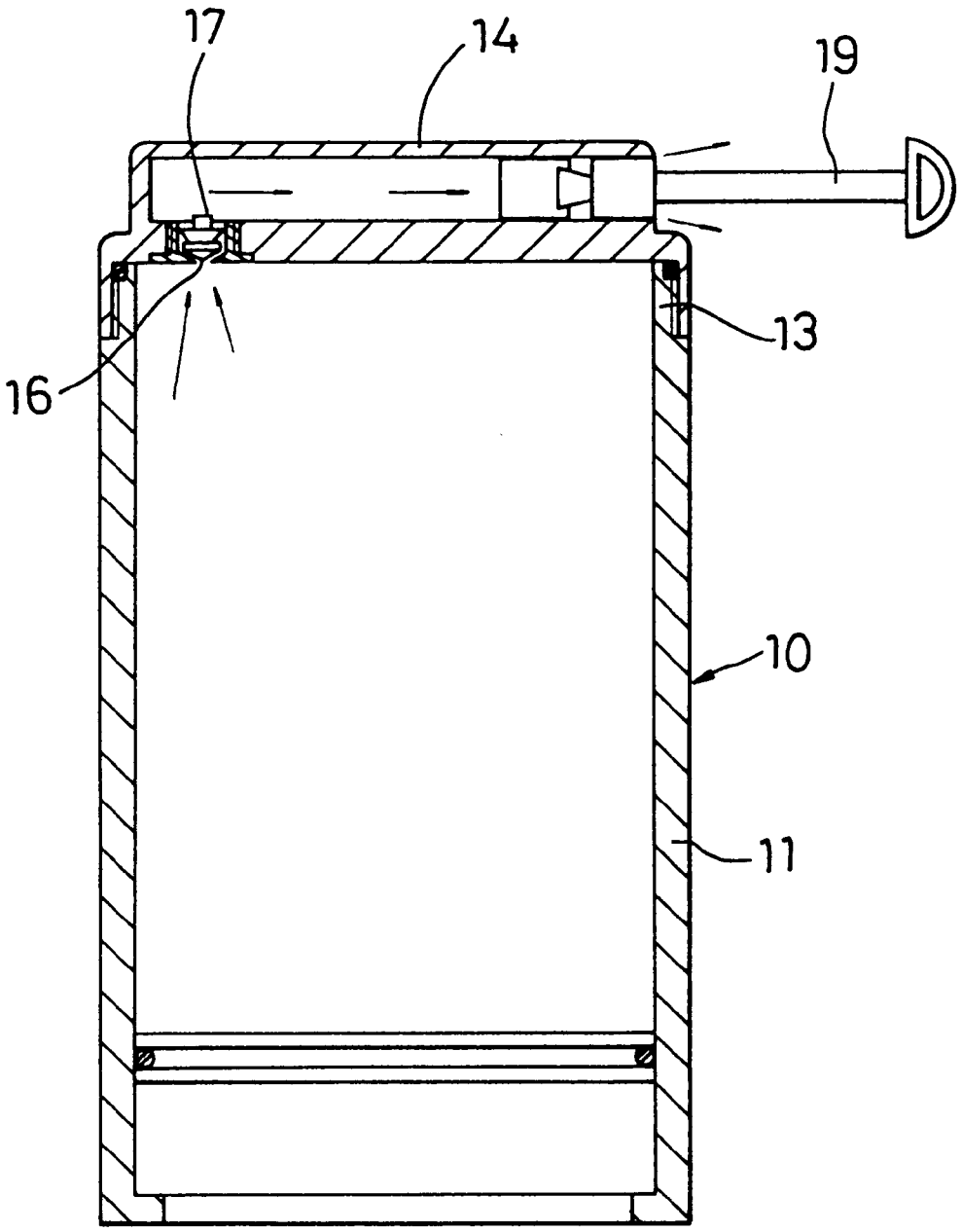
FIG. 1 PRIOR ART
FIG. 1 is a sectional view of a conventional vacuum container.

Before the present invention is described in greater detail, it should be noted that same reference numerals have been used to denote like elements throughout the specification.

Figure 2:
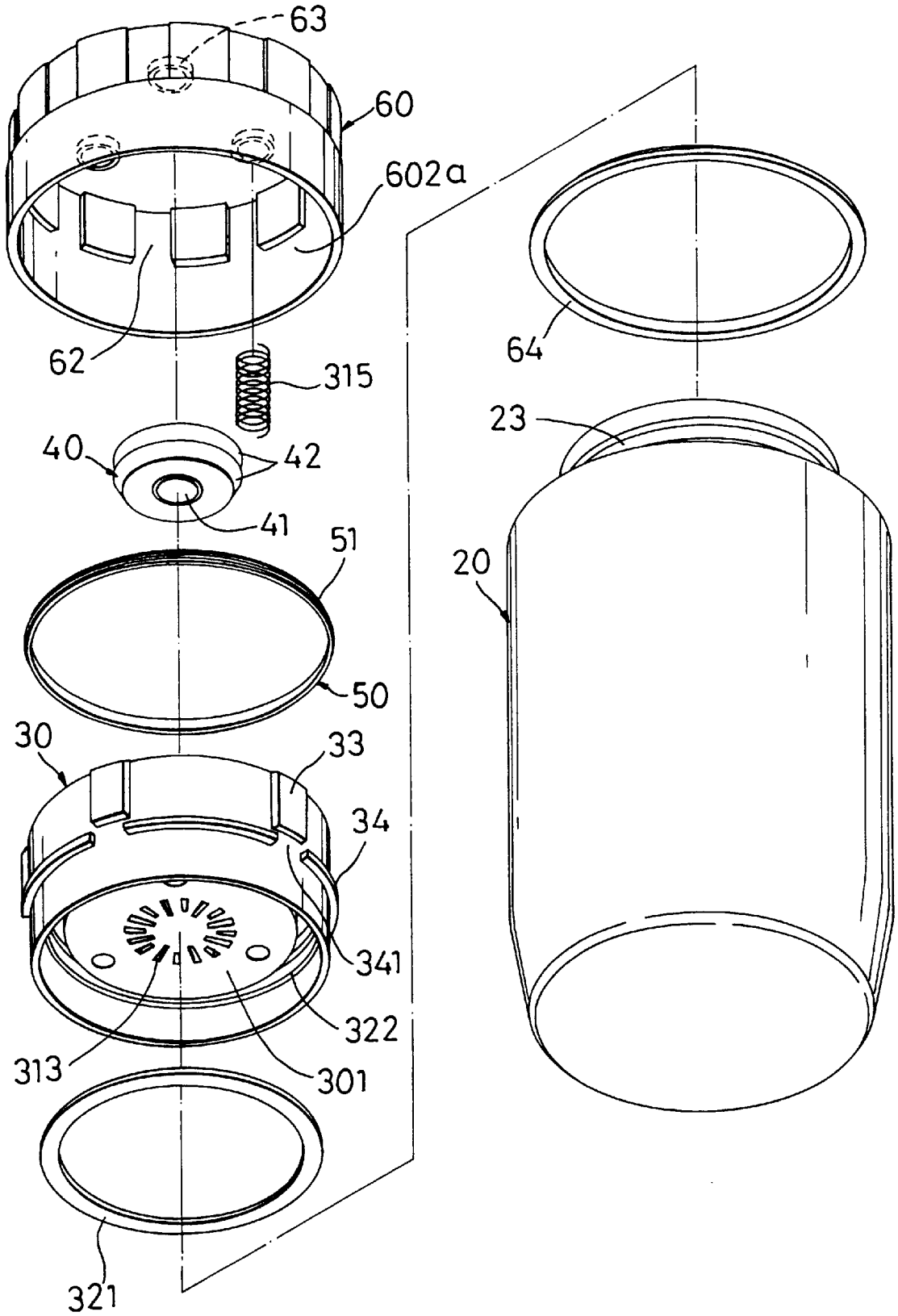
FIG. 2 is an exploded view of a container body and a first preferred embodiment of an evacuation actuating closure according to this invention.
Figure 3:
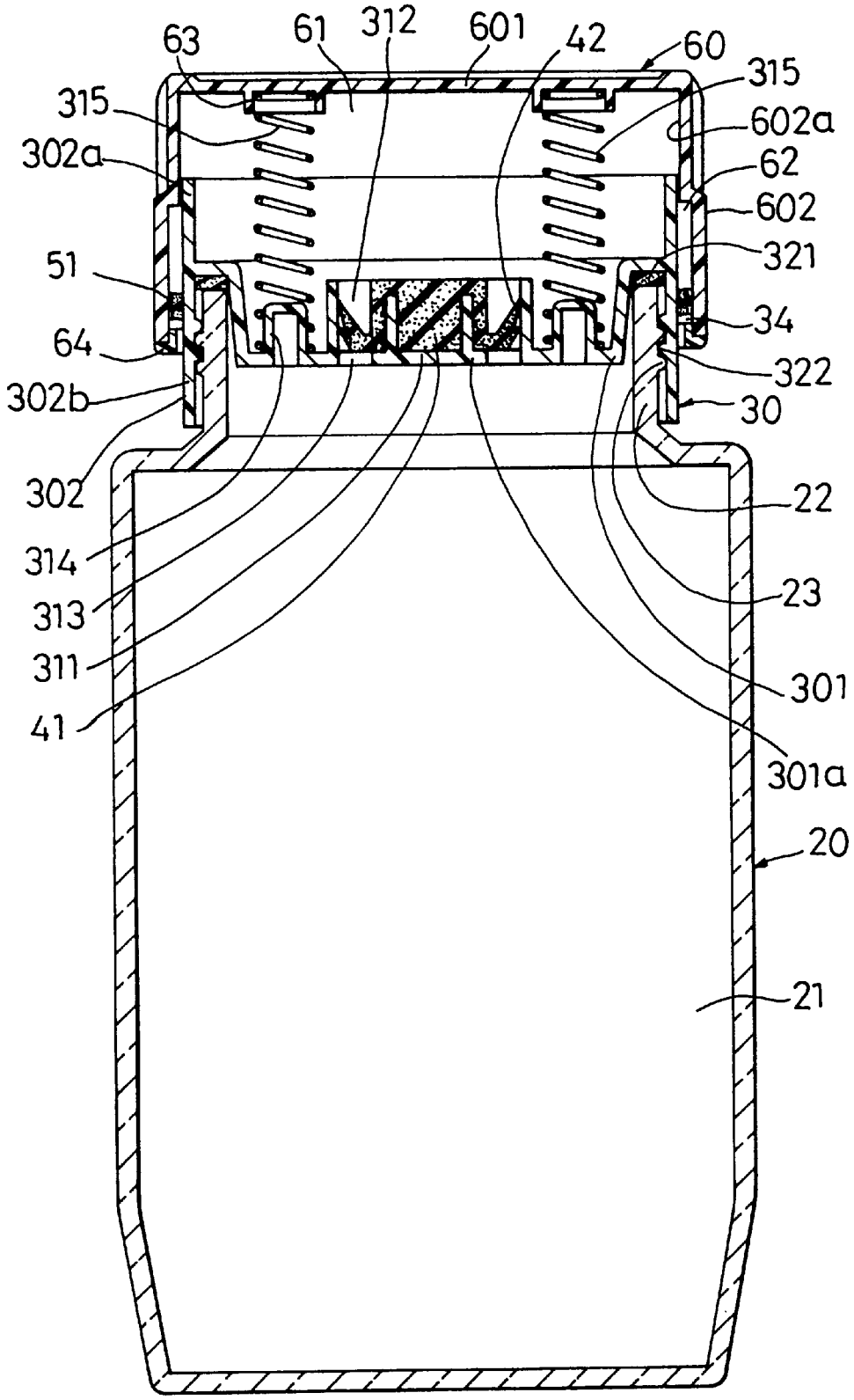
FIG. 3 is a sectional view illustrating how the closure of the preferred embodiment is mounted initially on the container body.

Referring to FIGS. 2 and 3, the first preferred embodiment of an evacuation actuating closure according to the present invention is shown to comprise a lower cap member 30, an elastomeric disc member 40, an upper cap member 60, and a ring-shaped check valve 50.

The lower cap member 30 includes a valve seat plate 301 and an annular guiding wall 302 which is formed with a periphery of the valve seat plate 301 and which extends in a longitudinal direction of the annular upper wall 22 of a container body 20. The valve seat plate 301 is adapted to be disposed transverse to the annular upper wall 22, and defines a central area with a plurality of valve seats which are angularly and circumferentially disposed therein and which define a plurality of venting holes 313 to form a circumferential venting portion. In this embodiment, the valve seat plate 301 extends inwardly and downwardly of the annular upper wall 22 of the container body 20. Inner and outer intermediate annular seat walls are disposed upwardly and transversely to the valve seat plate 301 on the central area to confine respectively an intermediate cavity 311 and an annular cavity 312. The annular guiding wall 302 has an upper annular portion 302*a* and a lower annular portion 302*b* disposed above and below the periphery of the valve seat plate 301, respectively. The lower annular portion 302*b* has a threaded part 322 in order to engage threadedly a threaded part 23 of the annular upper wall 22 of the container body 20. An O-ring 321 is disposed between the lower annular portion 302*b* and the annular upper wall 22 so as to establish an air-tight seal therebetween. Three lower spring-mounting posts 314 are mounted on the valve seat plate 301 around the central area. In addition, a plurality of guiding ribs 33 are provided spacedly on an outer annular wall of the annular guiding wall 302. An annular stop flange 34 is also formed on the outer annular wall of the annular guiding wall 302 and has a plurality of notches 341 at the guiding ribs 33.

Figure 4:
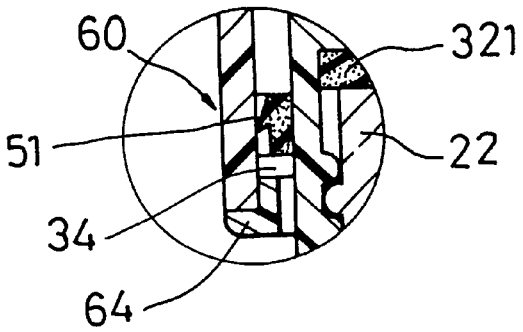
FIG. 4 is an enlarged sectional view showing a portion of FIG. 3.

With reference to FIG. 4, the elastomeric disc member 40 includes an elastomeric central portion 41 which is fixedly secured in the intermediate cavity 311, and a peripheral brim portion 42 which is disposed to abut resiliently against the outer intermediate annular seat wall to block the venting holes 313. The brim portion 42 yields from abutment against the outer intermediate annular seat wall only when the pressure below the venting holes 313 is higher than that above the venting holes 313.

The upper cap member 60 includes a transverse depression portion 601 which is disposed over and which is spaced apart from the valve seat plate 301, and an annular skirt portion 602 which extends downwardly from a periphery of the transverse depression portion 601 and which has an inner annular wall 602*a* that is sleeved on the annular guiding wall 302 so as to confine an air transit chamber 61 between the transverse depressing portion 601 and the valve seat plate 301. The transverse depressing portion 601 has three lower spring-mounting posts 63 which extend downward therefrom to correspond with the upper spring-mounting posts 314 for mounting three compression springs 315 that constitute a biasing member. Each spring 315 engages the corresponding upper and lower spring-mounting posts 314, 63. A plurality of guiding grooves 62 are formed on the inner annular wall 602*a* such that the guiding ribs 33 engage slidably the guiding grooves 62 to retain slidably the upper cap member 60 in the longitudinal direction relative to the lower cap member 30. In addition, a limit ring 64 is provided on a lower edge of the annular skirt portion 602 to prevent removal of the upper cap member 60 from the lower cap member 30.

Figure 5:
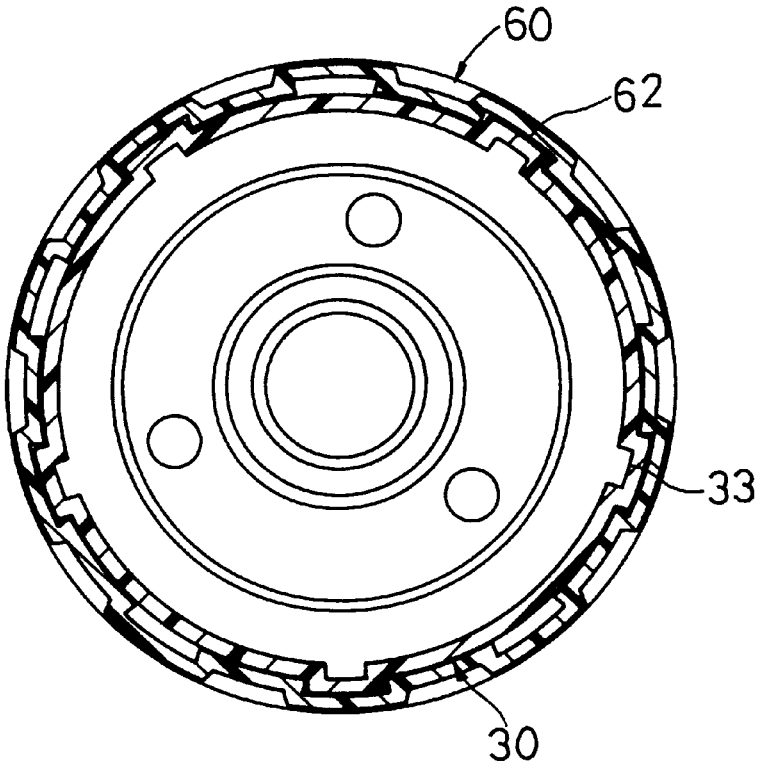
FIG. 5 is a cross sectional view of the closure of the first preferred embodiment.

With reference to FIG. 5, the check valve member 50 is made of an elastomeric material and is disposed between the annular stop flange 34 and the guiding ribs 33. The check valve member 50 has an annular valve wall 51 that inclines at a right angle. The valve wall 51 is disposed between the inner annular wall 602*a* and the annular guiding wall 302 so as to permit fluid communication of the air transit chamber 61 with the atmosphere only when the transverse depressing portion 601 is depressed downwardly toward the valve seat plate 301.

Figure 6:
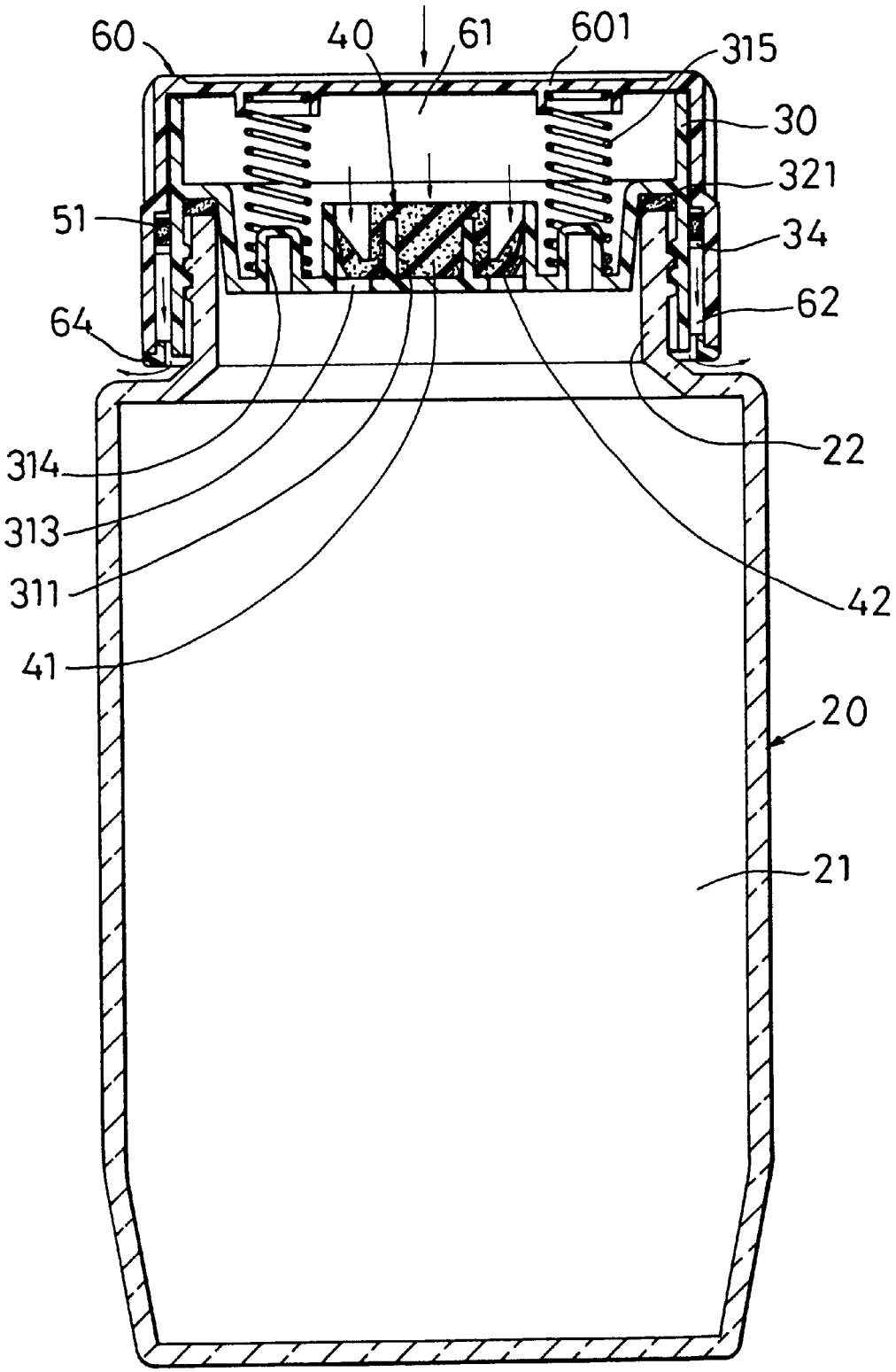
FIG. 6 is a sectional view of the closure of the first preferred embodiment in which an outer cap member is depressed downwardly.

As shown in FIG. 6, the transverse depressing portion 601 is depressed to move the upper cap member 60 downward so as to reduce the holding space of the air transit chamber 61 and increase its internal pressure. As such, air therein escapes out of the container body 20 through the check valve member 50 while prohibiting air from entering into the container body 20 by virtue of the peripheral brim portion 42 the elastomeric disc member 40.

Figure 7:
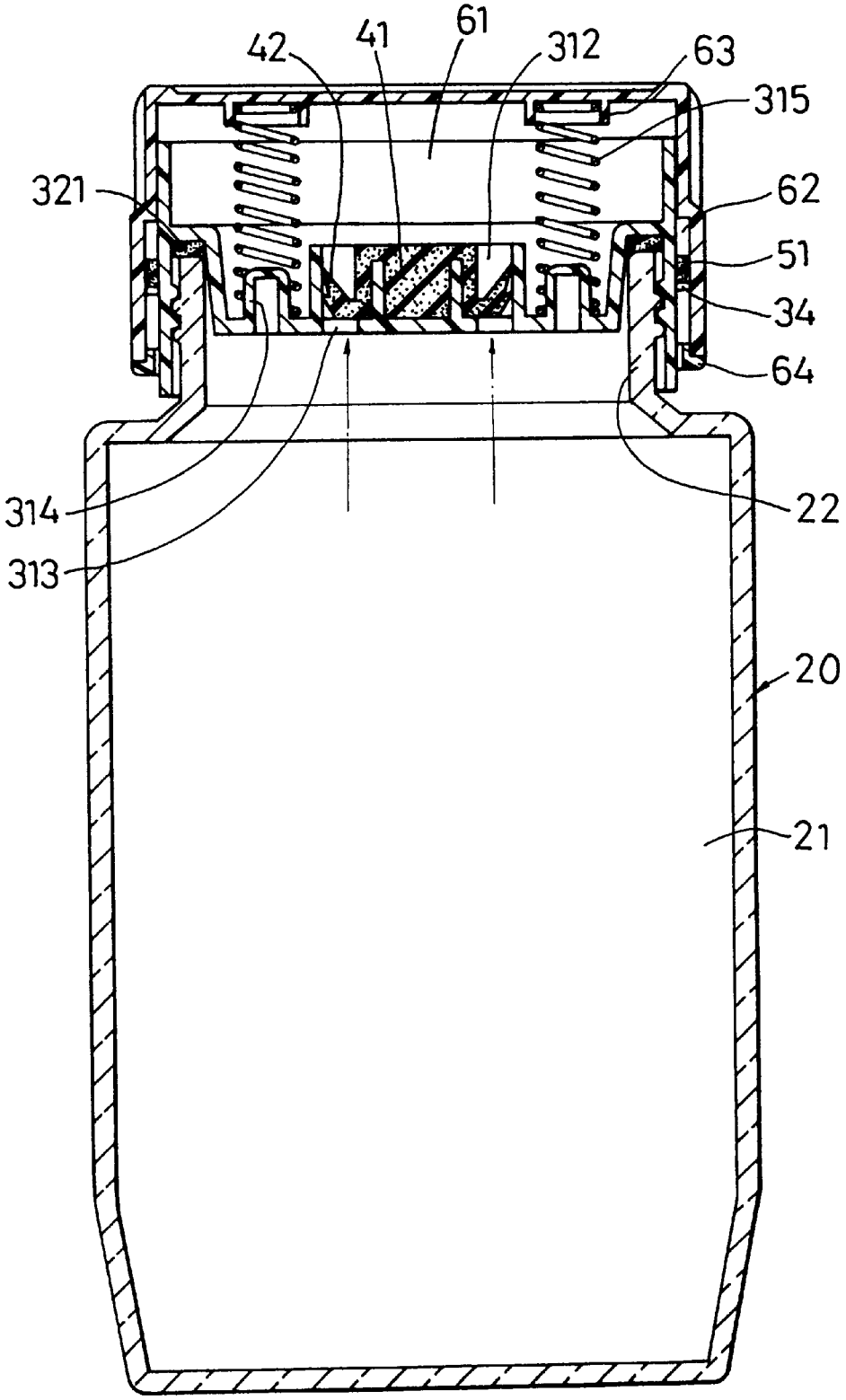
FIG. 7 is a sectional view of the closure of the first preferred embodiment in which the outer cap member is pressed upwardly by the air in the container body.

Referring to FIG. 7, once the transverse depressing portion 601 has been released from its depressed state, the upper cap member 60 returns back to its original position by virtue of the biasing force of the compression springs 315. As the holding space of the transit chamber 61 increases, the pressure therein is reduced, thereby producing an upward current of air in the container body 20 to enter into the transit chamber 61 through the venting holes 313. At the same time, the check valve member 50 is forced to seal the junction of the inner annular wall 602*a* and the annular guiding wall 302 to prohibit external air from entering into the closure. By repeating the aforesaid procedure, the containing chamber 21 of the container body 20 can be brought into an almost vacuum state.

As illustrated, the closure of the present invention has a circumferential venting portion so as to increase the air pumping effect. In addition, by virtue of the sliding engagement between the guiding ribs 33 and the guiding grooves 62, it is easy to operate the upper cap member 60 to place the container body 20 in the almost vacuum state.

Figure 8:
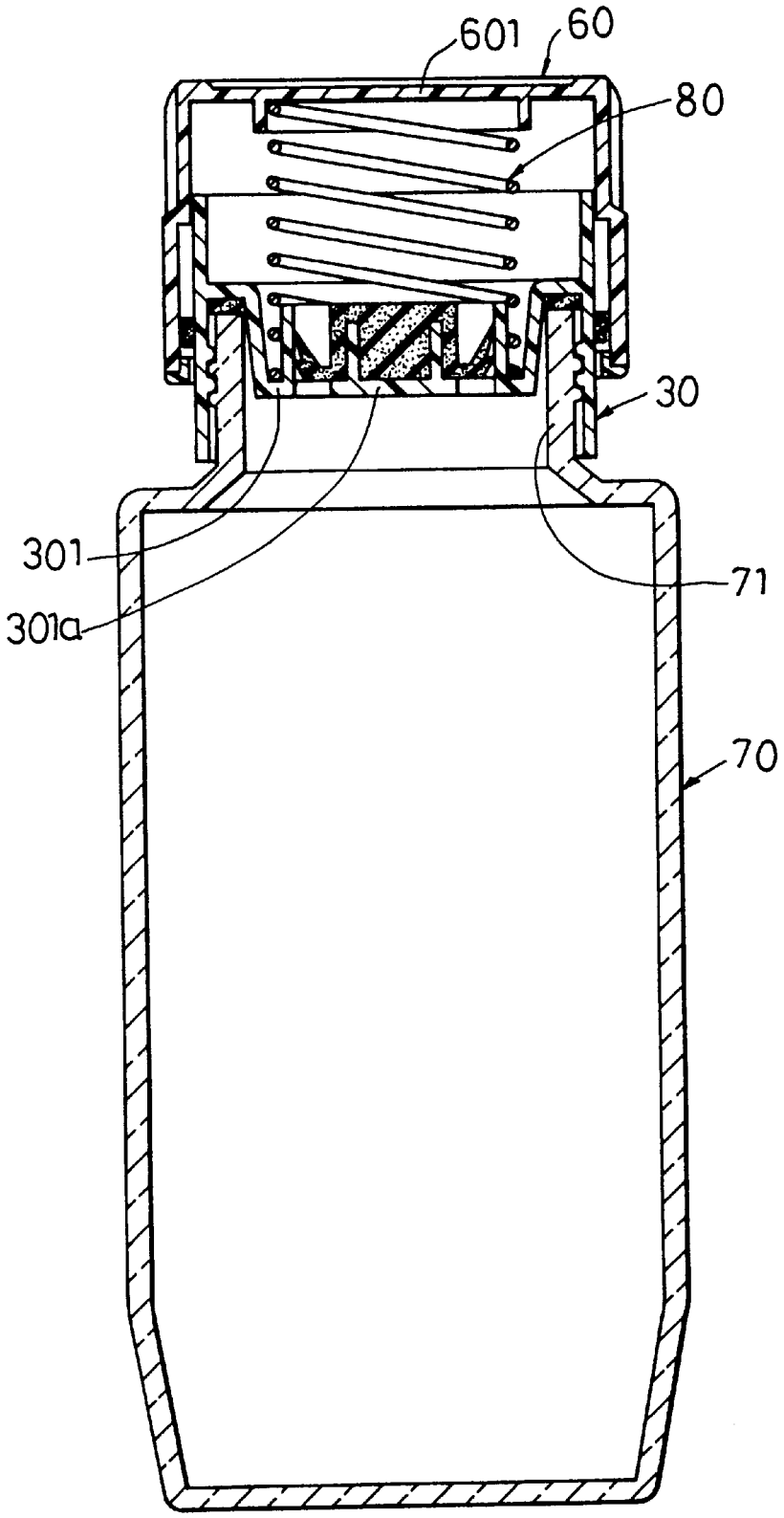
FIG. 8 is a sectional view illustrating how the closure of a second preferred embodiment according to this invention is mounted on a container body.

Referring to FIG. 8, the second preferred embodiment of the closure of this invention is shown to have upper and lower cap member 30,60 with diameters smaller than those in the first preferred embodiment so as to adapt the closure for mounting on a container body 70 with a relative small opening 71. Moreover, the biasing member includes a compression spring 80 which abuts against the transverse depressing portion 601 of the upper cap member 60 and the valve seat plate 301 of the lower cap member 30 at the central area 301*a*.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. An evacuation actuating closure for a container which includes a container body with an annular upper wall which defines a longitudinal direction and an upper opening therein to permit access to the interior of the container body, said evacuation actuating closure comprising:

a lower cap member including:

a valve seat plate adapted to be disposed transverse to the annular upper wall, said valve seat plate defining a central area with a plurality of valve seats which are angularly and circumferentially disposed therein and which define a plurality of venting holes that form a circumferential venting portion, and an intermediate annular seat wall disposed upwardly and transversely to said valve seat plate and confining said circumferential venting portion; and an annular guiding wall formed with a periphery of said valve seat plate and adapted to extend in the longitudinal direction so as to form upper and lower annular portions disposed respectively above and below the periphery of said valve seat plate, said lower annular portion being adapted to extend outwardly of and sealingly engage with the annular upper wall;

an elastomeric disc member including an elastomeric central portion fixedly secured on said central area, and a peripheral brim portion disposed to abut resiliently against said intermediate annular seat wall to block said venting holes, said peripheral brim portion yielding from abutment against said intermediate annular seat wall only when the pressure below said venting holes is higher than that above said venting holes;

an upper cap member including a transverse depressing portion disposed over and spaced apart from said valve seat plate, and an annular skirt portion extending downwardly from a periphery of said transverse depressing portion and having an inner annular wall which is sleeved on and which is slidably retained on said annular guiding wall in the longitudinal direction so as to confine an air transit chamber between said transverse depressing portion and said valve seat plate; and a ring-shaped check valve member made of an elastomeric material and disposed between said inner annular wall and said annular guiding wall such that said check valve member will permit fluid communication of said air transit chamber with the atmosphere only when said transverse depressing portion is depressed downwardly toward said valve seat plate.

2. The evacuation actuating closure as claimed in claim 1, further comprising a biasing member disposed to bias against depressing movement of said transverse depressing portion toward said valve seat plate.

3. The evacuation actuating closure as claimed in claim 2, wherein said biasing member includes a compression spring having two ends abutting against said transverse depressing portion and said valve seat plate, respectively.

4. The evacuation actuating closure as claimed in claim 1, wherein said valve seat plate is adapted to extend inwardly and downwardly of the annular upper wall of the container body.

5. The evacuation actuating closure as claimed in claim 1, further comprising an O-ring adapted to be disposed between said lower annular portion and the annular upper wall.

6. The evacuation actuating closure as claimed in claim 1, wherein said upper cap member further includes a plurality of guiding grooves formed in said inner annular wall of said annular skirt portion and extending in the longitudinal direction, said lower cap member further including a plurality of guiding ribs provided spacedly on an outer annular wall of said annular guiding wall to engage said guiding grooves for guiding sliding movement of said upper cap member relative to said lower cap member.

* * * * *